US005931434A

United States Patent [19]

Rodriguez

[11] Patent Number: 5,931,434

[45] Date of Patent: Aug. 3, 1999

[54] PROTECTOR FOR REMOTE CONTROL DEVICES

[76] Inventor: Luis Rodriguez, 13124 SW. 20 Terr., Miami, Fla. 33175

[21] Appl. No.: 08/946,396

[22] Filed: Oct. 7, 1997

[51] Int. Cl.[6] ..... A47B 95/00

[52] U.S. Cl. ..... 248/345.1; 206/305

[58] Field of Search ..... 248/345.1; 206/305, 206/320, 523, 521

[56] References Cited

U.S. PATENT DOCUMENTS

| | | | |
|---|---|---|---|
| 2,502,912 | 4/1950 | Andrew | 248/345.1 |
| 4,762,227 | 8/1988 | Patterson | 206/328 |
| 4,836,256 | 6/1989 | Meliconi . | |
| 4,925,149 | 5/1990 | DiFrancesca et al. | 248/345.1 |
| 5,475,382 | 12/1995 | Yuen et al. | 248/146 |

*Primary Examiner*—Leslie A. Braun
*Assistant Examiner*—Willie Berry, Jr.
*Attorney, Agent, or Firm*—J. Sanchelima

[57] ABSTRACT

A universal protector for remote control devices that includes a slotted elongated tubular member conformed in biting arrangement to the periphery of the devices. The universal protector can be readily adapted to practically all types of remote control devices, and by selecting a polyethylene material there is no need to take into consideration the path of the electromagnetic signal used to control the cooperating electronic equipment.

3 Claims, 1 Drawing Sheet

PROTECTOR FOR REMOTE CONTROL DEVICES

BACKGROUND OF THE INVENTION

1. Field of the Invention

The present invention relates to a protecting cover for remote control devices.

2. Description of the Related Art

Several devices have been designed in the past to protect remote control devices, such as the ones used with T.V. receivers and other electronic equipment. These remote devices are tossed around and manipulated by children and others without much attention or case. Not infrequently they break. Thus, the need for protection.

Applicant believes that the closest references correspond to U.S. Pat. No. 4,824,059 issued to Butler in 1989 for a cushioning device for remote control television equipment and U.S. Pat. No. 4,836,256 issued to Meliconi in 1989 for a shockproof protective sheath for remote controls, in particular those of television receivers. However, Butler and Meliconi's patents differ from the present invention because require a through opening to allow the passage of the control signal. The present invention, on the other hand, discloses a cover around a remote control device that does not require openings yet allows emission of control signals to electronic equipment.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a protector for remote control devices used for T.V. and other electronic appliances that are delicate and susceptible to falling and damage.

It is another object of this invention to provide a protector that can be readily conformed to the periphery of the housing of these devices so that it can be readily installed.

It is yet another object of this invention to provide such a protector that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DESCRIPTION OF THE PREFERRED EMBODIMENT

Figure 1:
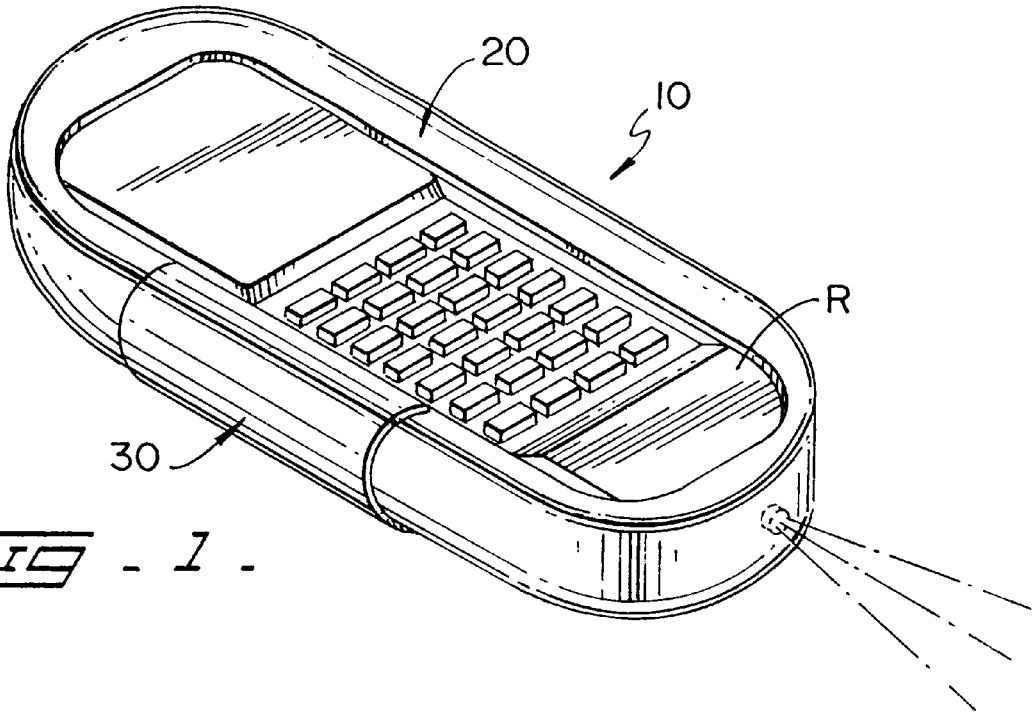
FIG. 1 is a view in perspective of a remote control being protected by the invention.

Referring now to the drawings, where the present invention is generally referred to with numeral 10, it can be observed that it basically includes tubular member 20 and locking member 30.

Tubular member 20 is a hollow housing with ends 22 and 24. Longitudinal slot 21 permits the insertion of the periphery edge of remote control device R into. Tubular member 20 has a sufficiently large diameter to prevent, if accidentally dropped, any contact with device R. Tubular member 20, in the preferred embodiment, has wire core 26 mounted internally so that it can be bent to conform to the periphery of the housing of the device being protected. Wire core 26 is preferably a deformable rigid wire such as aluminum alloy wire.

It has been found that certain foam materials do not materially affect the transmission of the infrared control signals used in typical remote control devices used for TVs and other appliances. Tubular member 20 includes a peripheral wall defining a contour through which infrared control signals are radiated. Tubular member 20 is preferably made out of a tough closed air cell polyethylene material which is energy absorbent, resilient, lightweight, and moisture and chemical resistant, such as polyethylene and polyolefin #30000. This material is manufactured by Foamcraft Inc. located at 947 West Van Buren Street, Chicago Ill. 60607. Part members 31000-R, for instance, has given good results.

Figure 2:
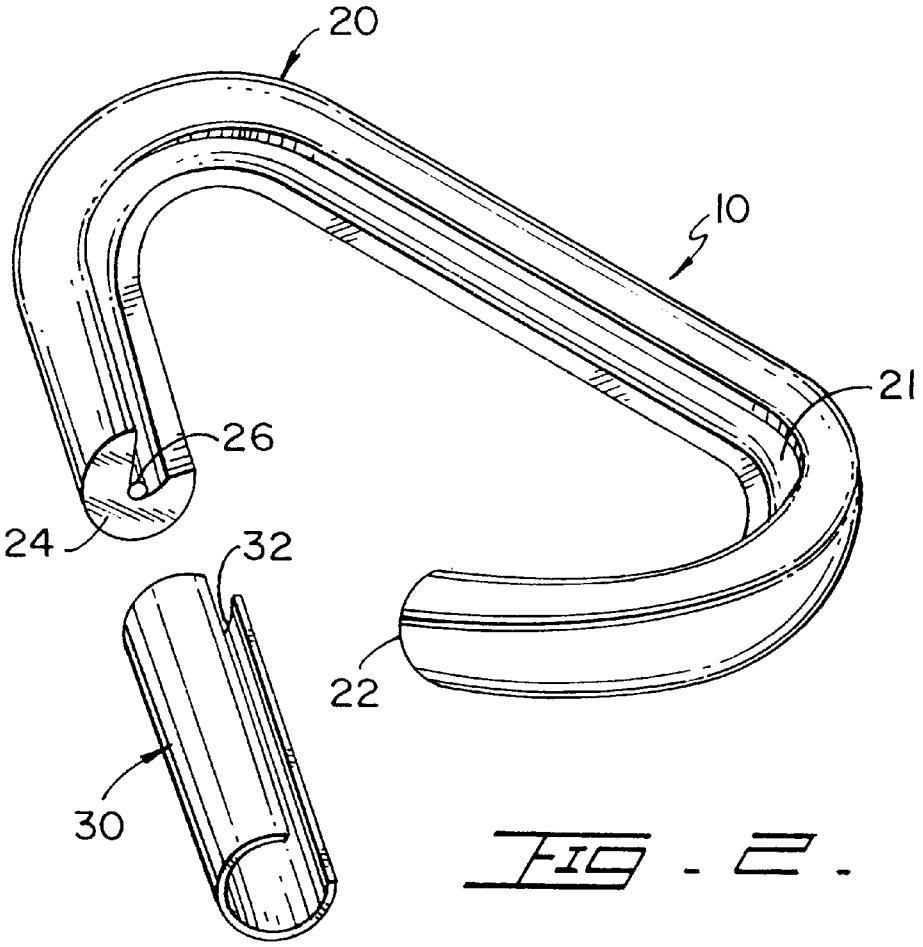
FIG. 2 is a view in perspective of a tubular foam member and the locking member used in the preferred embodiment disassembled.

As illustrated in FIGS. 1 and 2, protector assembly 10 includes locking tubular member 30 that has a diameter big enough to snugly and slidably fit onto ends 22 and 24 of tubular member 20. Locking tubular member 30 is made out of a rigid and resilient plastic material. Locking tubular member 30 has a "C-shape" configuration and slot 32 that allows member 30 to embrace and keep in place foam tubular member 20 while an electronic appliance has being protected.

By using polyethylene a protector with these universal application characteristics that conform to any device can be inexpensively manufactured. It does not require taylor made protectors that take into consideration the characteristics of the remote control to provide for an opening or other unobstructed characteristics.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A universal protector for a device that remotely controls electronic equipment by radiating an infrared signal and said device includes a peripheral wall defining a contour through which said signal is radiated, comprising:

A) an elongated member having two ends and a longitudinally extending slot defining two longitudinal edges, said elongated member being made out of closed air cell polyethylene and having sufficiently large diameter for said longitudinal edges to bite around the contour of said device whereby said elongated member is adapted to cover said infrared signal and permits said signal to pass through said elongated member; and B) locking means for keeping said ends firmly and removably attached to each other so that said devices are prevented from being damaged.

2. The universal protector set forth in claim 1 wherein said elongated tubular member includes a longitudinally extending deformable rigid member positioned substantially centrally therethrough and so constructed to permit the combination to adapt and follow the contour of said devices.

3. The universal protector set forth in claim 2 wherein said locking means includes a substantially C-shape member made out of a resilient material and having cooperative dimensions to snugly and slidably receive said ends.

* * * * *